US011639480B1

(12) United States Patent
Baker

(10) Patent No.: US 11,639,480 B1
(45) Date of Patent: May 2, 2023

(54) PHOSPHORUS ANTIWEAR SYSTEM FOR IMPROVED GEAR PROTECTION

(71) Applicant: Afton Chemical Corporation, Richmond, VA (US)

(72) Inventor: John Marshall Baker, Bracknell (GB)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 17/844,315

(22) Filed: Jun. 20, 2022

(51) Int. Cl.

| | |
|---|---|
| ***C10M 137/10*** | (2006.01) |
| ***C10M 109/00*** | (2006.01) |
| ***C10M 171/02*** | (2006.01) |
| *C10N 40/04* | (2006.01) |
| *C10N 20/02* | (2006.01) |

(52) U.S. Cl.
CPC ..... *C10M 137/105* (2013.01); *C10M 109/00* (2013.01); *C10M 171/02* (2013.01); *C10M 2223/047* (2013.01); *C10N 2020/02* (2013.01); *C10N 2040/04* (2013.01)

(58) Field of Classification Search
CPC ..... C10N 2040/04; C10N 2030/06; C10M 137/00; C10M 141/10; C10M 2223/047; C10M 2223/043; C10M 2215/04; C10M 2215/06; C10M 2215/086; C10M 2215/08; C10M 2217/043
See application file for complete search history.

(56) References Cited

U.S. PATENT DOCUMENTS

| | | | |
|---|---|---|---|
| 2,237,625 | A | 4/1941 | Olin |
| 2,237,627 | A | 4/1941 | Olin |
| 2,527,948 | A | 10/1950 | Lyon, Jr. et al. |
| 2,695,316 | A | 11/1954 | McBride |
| 2,995,569 | A | 8/1961 | Hamilton et al. |
| 3,022,351 | A | 2/1962 | Mihm et al. |
| 3,219,666 | A | 11/1965 | Norman et al. |
| 3,308,166 | A | 3/1967 | Biensan et al. |
| 3,392,201 | A | 7/1968 | Warner |
| 3,471,404 | A | 10/1969 | Myers |
| 3,565,804 | A | 2/1971 | Honnen et al. |
| 3,634,515 | A | 1/1972 | Piasek et al. |
| 3,673,090 | A | 6/1972 | Waldbillig et al. |
| 3,697,574 | A | 10/1972 | Piasek et al. |
| 3,703,504 | A | 11/1972 | Horodysky |
| 3,703,505 | A | 11/1972 | Horodysky et al. |
| 3,736,357 | A | 5/1973 | Piasek et al. |
| 3,796,661 | A | 3/1974 | Suratwala et al. |
| 3,873,454 | A | 3/1975 | Horodysky et al. |
| 4,119,549 | A | 10/1978 | Davis |
| 4,119,550 | A | 10/1978 | Davis et al. |
| 4,147,640 | A | 4/1979 | Jayne et al. |
| 4,191,659 | A | 3/1980 | Davis |
| 4,204,969 | A | 5/1980 | O'Brien et al. |
| 4,218,332 | A | 8/1980 | Schwab et al. |
| 4,234,435 | A | 11/1980 | Meinhardt et al. |
| 4,240,958 | A | 12/1980 | Braid |
| 4,344,854 | A | 8/1982 | Davis et al. |
| 4,472,306 | A | 9/1984 | Powers, III et al. |
| 4,564,709 | A | 1/1986 | Koyama et al. |
| 4,636,322 | A | 1/1987 | Nalesnik |
| 4,711,736 | A | 12/1987 | Horodysky et al. |
| 4,795,576 | A | 1/1989 | Born et al. |
| 4,954,274 | A | 9/1990 | Zaweski et al. |
| 4,966,720 | A | 10/1990 | DeGonia et al. |
| 5,266,223 | A | 11/1993 | Song et al. |
| 5,627,259 | A | 5/1997 | Thaler et al. |
| 5,633,326 | A | 5/1997 | Patil et al. |
| 5,643,859 | A | 7/1997 | Gutierrez et al. |
| 5,792,729 | A | 8/1998 | Harrison et al. |
| 5,851,965 | A | 12/1998 | Harrison et al. |
| 5,853,434 | A | 12/1998 | Harrison et al. |
| 5,936,041 | A | 8/1999 | Diana et al. |
| 9,481,696 | B1 | 11/2016 | Edwards et al. |
| 11,214,750 | B2 | 1/2022 | Milner |
| 2012/0101017 | A1 | 4/2012 | Duggal |
| 2016/0281020 | A1* | 9/2016 | Yamamoto ..... C10M 163/00 |
| 2018/0002631 | A1* | 1/2018 | Milner ..... C10M 137/00 |

FOREIGN PATENT DOCUMENTS

| | | | |
|---|---|---|---|
| EP | 0612839 | A1 | 8/1994 |
| GB | 1162334 | A | 8/1969 |

OTHER PUBLICATIONS

W. W. Yau, J. J. Kirkland and D. D. Bly, "Modern Size Exclusion Liquid Chromatography", John Wiley and Sons, New York, 1979.

* cited by examiner

*Primary Examiner* — Vishal V Vasisth
(74) *Attorney, Agent, or Firm* — Clay Matthews; Honigman LLP

(57) ABSTRACT

A lubricating composition for a transmission or gearbox including a mixture of products providing phosphorus to the fluids effective to achieve good adhesive wear and abrasive wear.

18 Claims, No Drawings

PHOSPHORUS ANTIWEAR SYSTEM FOR IMPROVED GEAR PROTECTION

TECHNICAL FIELD

The present disclosure relates to lubricating compositions for transmissions and gearboxes.

BACKGROUND

Transmissions and gearboxes are often subjected to pressures and loads over time that may cause wear to various gear surfaces in the driveline. Lubricants can be used to minimize and prevent wear damage. This is most often achieved using phosphorus-based antiwear compounds as lubricant additives. Newer transmission lubricants are expected to be of lower viscosity to improve efficiency and fuel economy while having longer drain intervals to save on equipment maintenance costs. Thus, newer lubricants are required to protect gear systems longer and under more severe conditions.

Transmission gear wear is generally understood to be damage to an individual gear tooth surface, which involves progressive loss of material over time due to contact motion between individual gear teeth. There are, of course, different types of component wear that need to be eliminated. Two relevant wear mechanisms in the context of transmission gears include abrasive wear as measured pursuant to ASTM D4172 and adhesive wear as measured pursuant to CEC L-84. Achieving passing performance in both wear mechanisms in lower viscosity fluids has been challenging because selecting fluid additives to achieve good abrasive wear does not necessarily lead to acceptable adhesive wear, and vice versa.

SUMMARY

In one approach or embodiment, a transmission or gearbox lubricating composition is provided herein. In aspects, the lubricating composition includes (i) a base oil of lubricating viscosity; (ii) a first phosphorus compound comprising a trialkyl phosphate ester of Formula I:

(Formula I)

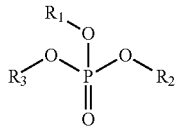

wherein $R_1$, $R_2$, and $R_3$ are, independently, a C4 to C8 linear or branched alkyl group; (iii) a second phosphorus compound comprising an ashless, dialkyl dithiophosphate of Formula II, or a salt thereof:

(Formula II)

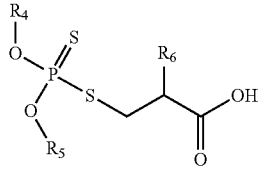

wherein $R_4$ and $R_5$ are, independently, a C3 to C8 linear or branched alkyl group, and $R_6$ is —H or —$CH_3$; (iv) a third phosphorus compound prepared by reacting an O,O-di (4-methyl-2-pentyl) phosphorodithioic acid with ethylene and/or propylene oxide to provide a first reaction product and further reacting said first reaction product with phosphorus pentoxide to provide a second reaction product and neutralizing said second reaction product with one or more tertiary aliphatic primary amines to obtain or provide said third phosphorus compound; and wherein said first, second, and third phosphorus compounds provide a total of about 800 to about 2000 ppm phosphorus to the lubricating composition.

In other approaches or embodiments, the lubricating composition of the previous paragraph may be combined with one or more optional features in any combination. Such optional features include one or more of the following: wherein the first phosphorus compound is tris (2-ethylhexyl) phosphate; and/or wherein the first phosphorus compound provides about 280 ppm to about 840 ppm of phosphorus to the lubricating composition; and/or wherein the second phosphorus compound is 3-[[bis(2-methylpropoxy) phosphinothioyl]thio]-2-methyl-propanoic acid; and/or wherein the second phosphorus compound provides about 90 to about 450 ppm of phosphorus to the lubricating composition; and/or wherein the third phosphorus compound provides about 80 to about 600 ppm of phosphorus to the lubricating composition; and/or wherein the first phosphorus compound provides about 280 ppm to about 840 ppm of phosphorus to the lubricating composition, the second phosphorus compound provides about 90 to about 450 ppm of phosphorus to the lubricating composition, and the third phosphorus compound provides about 180 to about 600 ppm of phosphorus to the lubricating composition; and/or wherein the lubricating composition exhibits a wear scar of about 0.5 mm or less pursuant to ASTM D4172 (40 kgf) and has a fail load stage rating of 10 or higher pursuant to CEC L-84 at 90° C.; and/or wherein about 30 to about 60 weight percent of the total phosphorus is provided by the first phosphorus compound, about 12 to about 35 weight percent of the total phosphorus is provided by the second phosphorus compound, and about 20 to about 35 weight percent of the total phosphorus is provided by the third phosphorus compound; and/or wherein the lubricating composition has a KV100 of about 4 to about 15 cSt; and/or wherein the lubricating composition includes more of the first phosphorus compound, in terms of phosphorus content, than the second and third phosphorus compounds combined.

In other embodiments or approaches, a method of lubricating a transmission or gearbox is provided herein. In aspects, the method includes lubricating a transmission or gearbox component with a lubricating composition; and wherein the lubricating composition includes (i) a base oil of lubricating viscosity; and (ii) a first phosphorus compound comprising a trialkyl phosphate ester of Formula I:

(Formula I)

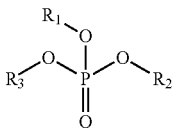

wherein $R_1$, $R_2$, and $R_3$ are, independently, a C4 to C8 linear or branched alkyl group, (iii) a second phosphorus compound comprising an ashless, dialkyl dithiophosphate of Formula II, or a salt thereof:

(Formula II)

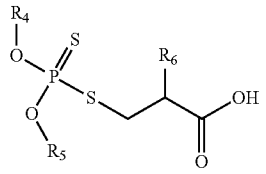

wherein $R_4$ and $R_5$ are, independently, a C3 to C8 linear or branched alkyl group, and $R_6$ is —H or —$CH_3$, and (iv) a third phosphorus compound prepared by reacting an O,O-di (4-methyl-2-pentyl) phosphorodithioic acid with ethylene and/or propylene oxide to provide a first reaction product and further reacting said first reaction product with phosphorus pentoxide to provide a second reaction product and neutralizing said second reaction product with one or more tertiary aliphatic primary amines to obtain or provide said third phosphorus compound; and wherein said first, second, and third phosphorus compounds provide a total of about 800 to about 2000 ppm phosphorus to the lubricating composition.

In other approaches or embodiments, the method embodiments of the previous paragraph may be combined with one or more optional features, steps, or limitations in any combination. These optional features, steps, or limitations including one or more of the following: wherein the first phosphorus compound is tris (2-ethylhexyl) phosphate; and/or wherein the first phosphorus compound provides about 280 ppm to about 840 ppm of phosphorus to the lubricating composition; and/or wherein the second phosphorus compound is 3-[[bis(2-methylpropoxy) phosphinothioyl]thio]-2-methyl-propanoic acid; and/or wherein the second phosphorus compound provides about 90 to about 450 ppm of phosphorus to the lubricating composition; and/or wherein the third phosphorus compound provides about 180 to about 600 ppm of phosphorus to the lubricating composition; and/or wherein the lubricating composition exhibits a wear scar of about 0.5 mm or less pursuant to ASTM D4172 (40 kgf) and has a fail load stage rating of 10 or higher pursuant to CEC L-84 at 90° C.; and/or wherein about 30 to about 60 weight percent of the total phosphorus is provided by the first phosphorus compound, about 12 to about 35 weight percent of the total phosphorus is provided by the second phosphorus compound, and about 20 to about 35 weight percent of the total phosphorus is provided by the third phosphorus compound; and/or wherein the lubricating composition has a KV100 of about 4 to about 10 cSt; and/or wherein the lubricating composition includes more of the first phosphorus compound, in terms of phosphorus content, than the second and third phosphorus compounds combined; and/or wherein the first phosphorus compound provides about 280 ppm to about 840 ppm of phosphorus to the lubricating composition; the second phosphorus compound provides about 90 to about 450 ppm of phosphorus to the lubricating composition, and the third phosphorus compound provides about 180 to about 600 ppm of phosphorus to the lubricating composition.

In yet other approaches or embodiments, the use of a first phosphorus compound, a second phosphorus compound, and a third phosphorus compound to provide lubricant, preferably in a driveline, exhibiting a wear scar of about 0.5 mm or less pursuant to ASTM D4172 (40 kgf) and a fail load stage rating of 10 or higher pursuant to CEC L-84 at 90° C. is provided herein wherein the first phosphorus compound comprises a trialkyl phosphate ester of Formula I:

(Formula I)

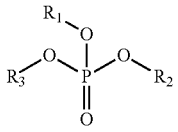

wherein $R_1$, $R_2$, and $R_3$ are, independently, a C4 to C8 linear or branched alkyl group, (iii) the second phosphorus compound comprises an ashless, dialkyl dithiophosphate of Formula II, or a salt thereof:

(Formula II)

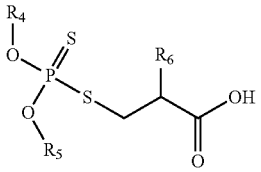

wherein $R_4$ and $R_5$ are, independently, a C3 to C8 linear or branched alkyl group, and $R_6$ is —H or —$CH_3$, and (iv) the third phosphorus compound is prepared by reacting an O,O-di (4-methyl-2-pentyl) phosphorodithioic acid with ethylene and/or propylene oxide to provide a first reaction product and further reacting said first reaction product with phosphorus pentoxide to obtain or provide a second reaction product and neutralizing said second reaction product with one or more tertiary aliphatic primary amines to provide said third phosphorus compound.

In yet further embodiments, a driveline apparatus is provided herein wherein the driveline includes a lubricating composition including any embodiment herein of the first phosphorus compound, the second phosphorus compound, and the third phosphorus compound.

Other embodiments of the present disclosure will be apparent to those skilled in the art from consideration of the specification and practice of the invention disclosed herein. The following definitions of terms are provided in order to clarify the meanings of certain terms as used herein.

The terms "gear oil," "gear fluid," "gear lubricant," "base gear lubricant," "lubricating oil," "lubricant composition," "lubricating composition," "lubricant" and "lubricating fluid" refer to a finished lubrication product comprising a major amount of a base oil plus a minor amount of an additive composition as discussed herein. Such gear fluids are for use in extreme pressure situations such as for transmissions and gear drive components having metal-on-metal contact situations, for instance, in a transmission and/or a limited-slip differential.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

As used herein, the term "percent by weight" or "wt %", unless expressly stated otherwise, means the percentage the recited component represents to the weight of the entire composition. All percent numbers herein, unless specified otherwise, is weight percent.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "alkyl" as employed herein refers to straight, branched, cyclic, and/or substituted saturated chain moieties from about 1 to about 200 carbon atoms. The term "alkenyl" as employed herein refers to straight, branched, cyclic, and/or substituted unsaturated chain moieties from about 3 to about 30 carbon atoms. The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, and oxygen.

As used herein, the molecular weight is determined by gel permeation chromatography (GPC) using commercially available polystyrene standards (with a Mn of about 180 to about 18,000 as the calibration reference). The molecular weight (Mn) for any embodiment herein may be determined with a gel permeation chromatography (GPC) instrument obtained from Waters or the like instrument and the data processed with Waters Empower Software or the like software. The GPC instrument may be equipped with a Waters Separations Module and Waters Refractive Index detector (or the like optional equipment). The GPC operating conditions may include a guard column, 4 Agilent PLgel columns (length of 300×7.5 mm; particle size of 5μ, and pore size ranging from 100-10000 Å) with the column temperature at about 40° C. Un-stabilized HPLC grade tetrahydrofuran (THF) may be used as solvent, at a flow rate of 1.0 mL/min. The GPC instrument may be calibrated with commercially available polystyrene (PS) standards having a narrow molecular weight distribution ranging from 500-380,000 g/mol. The calibration curve can be extrapolated for samples having a mass less than 500 g/mol. Samples and PS standards can be in dissolved in THE and prepared at concentration of 0.1-0.5 weight percent and used without filtration. GPC measurements are also described in U.S. Pat. No. 5,266,223, which is incorporated herein by reference. The GPC method additionally provides molecular weight distribution information; see, for example, W. W. Yau, J. J. Kirkland and D. D. Bly, "Modern Size Exclusion Liquid Chromatography", John Wiley and Sons, New York, 1979, also incorporated herein by reference.

It is to be understood that throughout the present disclosure, the terms "comprises," "includes," "contains," etc. are considered open-ended and include any element, step, or ingredient not explicitly listed. The phrase "consists essentially of" is meant to include any expressly listed element, step, or ingredient and any additional elements, steps, or ingredients that do not materially affect the basic and novel aspects of the invention. The present disclosure also contemplates that any composition described using the terms, "comprises," "includes," "contains," is also to be interpreted as including a disclosure of the same composition "consisting essentially of" or "consisting of" the specifically listed components thereof.

DETAILED DESCRIPTION

Disclosed herein are lubricating compositions suitable for gear fluids, transmission fluids, power transmission fluids, and/or driveline applications that achieve good performance in both abrasive wear as measured pursuant to ASTM D4172 and adhesive wear as measured pursuant to CEC L-84. In one approach or embodiment, the lubricating compositions herein include a base oil of lubricating viscosity and a trio of phosphorus-containing antiwear compounds to achieve the passing adhesive wear and abrasive wear. In approaches, the trio of phosphorus containing compounds provide a total of about 800 ppm to about 2000 ppm phosphorus to the lubricating composition. In one aspect, the phosphorus-containing antiwear compounds include a first phosphorus compound of a trialkyl phosphate ester; a second phosphorus compound of an ashless, dialkyl dithiophosphate; and a third phosphorus compound of a dithiophosphate ester amine or salt thereof.

In approaches or embodiments, the first phosphorus compound is a trialkyl phosphate ester of Formula I.

(Formula I)

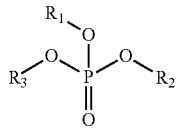

wherein $R_1$, $R_2$, and $R_3$ are, independently, a C4 to C8 linear or branched alkyl group; the second phosphorus compound is an ashless, dialkyl dithiophosphate of Formula II, or a salt thereof:

(Formula II)

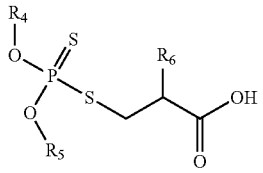

wherein $R_4$ and $R_5$ are, independently, a C3 to C8 linear or branched alkyl group, and $R_6$ is —H or —$CH_3$; and the third phosphorus compound is prepared by reacting an O,O-di (4-methyl-2-pentyl) phosphorodithioic acid with ethylene and/or propylene oxide to provide a first reaction product and further reacting said first reaction product with phosphorus pentoxide to provide a second reaction product and neutralizing said second reaction product with one or more tertiary aliphatic primary amines to provide said third phosphorus compound. Each phosphorus compound will be discussed further below.

First Phosphorus Compound

In embodiments or approaches, the first phosphorus compound is an ashless (metal free) phosphorus-containing compound in the form of a trialkyl phosphate ester. In some approaches or embodiments, the first phosphorus compound provides about 280 ppm to about 840 ppm of phosphorus to the lubricating composition, in other approaches, about 420 ppm to about 770 ppm of phosphorus, in further approaches, about 420 ppm to about 560 ppm, or in yet other approaches, about 560 ppm to about 840 ppm of phosphorus. In alternative approaches, the lubricating compositions herein include about 0.4 weight percent to about 1.2 weight percent of the first phosphorus compound, in other approaches, about 0.6 weight percent to about 1.1 weight percent, in further approaches, about 0.6 to about 0.8 weight percent, or in yet other approaches, about 0.8 to about 1.2 weight percent of the first phosphorus compound.

In other approaches or embodiments, the first phosphorus compound provides phosphorus to the lubricating composition in an amount ranging from at least about 280 ppm, at least about 300 ppm, at least about 320 ppm, at least about 340 ppm, at least about 360 ppm, at least about 380 ppm, at least about 400 ppm, at least about 420 ppm, at least about 440 ppm, at least about 460 ppm, at least about 480 ppm, at least about 500 ppm, at least about 520 ppm, at least about 540 ppm, or at least about 560 ppm to about 840 ppm or less, about 820 ppm or less, about 780 ppm or less, about 760 ppm or less, about 740 ppm or less, about 720 ppm or less, about 700 ppm or less, about 680 ppm or less, about 660 ppm or less, about 640 ppm or less, about 620 ppm or less, about 600 ppm or less, about 580 ppm or less, or about 560 ppm or less. In other approaches, the treat rate of the first phosphorus compound in the lubricating composition may range from at least about 0.4 weight percent, at least about 0.5 weight percent, at least about 0.6 weight percent, at least about 0.7 weight percent, at least about 0.8 weight percent to about 1.2 weight percent or less, about 1.0 weight percent or less, about 0.9 weight percent or less, about 0.8 weight percent or less.

In other approaches, the first phosphorus compound may have a structure of Formula I:

(Formula I)

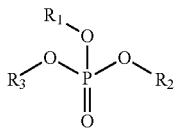

wherein $R_1$, $R_2$, and $R_3$ are, independently, a C4 to C8 linear or branched alkyl group. The first phosphorus-containing compound may have about 5 to about 10 weight percent phosphorus. In one preferred approach, the first phosphorus product may be tris (2-ethylhexyl) phosphate.

Second Phosphorus Compound

In approaches or embodiments, the second phosphorus compound of the compositions herein is an acidic thiophosphate or a thiophosphate ester, such as an ashless, amine free dialkyl dithiophosphate acid ester or sulfur-containing phosphoric acid ester. In other approaches or embodiments, the second phosphorus compound provides about 90 ppm to about 450 ppm of phosphorus to the lubricating composition, in other approaches, about 135 ppm to about 360 ppm of phosphorus, in further approaches, about 135 ppm to about 270 ppm, or in yet other approaches, about 225 ppm to about 360 ppm of phosphorus. In alternative approaches, the lubricating compositions herein include about 0.1 weight percent to about 0.5 weight percent of the second phosphorus compound, in other approaches, about 0.15 weight percent to about 0.4 weight percent, in further approaches, about 0.15 weight percent to about 0.3 weight percent, or in yet other approaches, about 0.3 weight percent to about 0.4 weight percent of the second phosphorus compound.

In other approaches or embodiments, the second phosphorus compound provides phosphorus to the lubricating composition in an amount ranging from at least about 90 ppm, at least about 100 ppm, at least about 120 ppm, at least about 140 ppm, at least about 160 ppm, at least about 180 ppm, at least about 200 ppm, at least about 220 ppm to about 360 ppm or less, about 340 ppm or less, about 320 ppm or less, about 300 ppm or less, or about 280 ppm or less. In yet other approaches, the treat rate of the first phosphorus compound in the lubricating composition may range from at least about 0.1 weight percent, at least about 0.15 weight percent, at least about 0.2 weight percent, at least about 0.25 weight percent, or at least about 0.3 weight percent to about 0.5 weight percent or less, about 0.45 weight percent or less, about 0.4 weight percent or less, about 0.35 weight percent or less, or about 0.3 weight percent or less, or about 0.25 weight percent or less.

The acidic thiophosphate, the thiophosphate ester, or the sulfur-containing phosphoric acid esters of the second phosphorus compound may have one or more sulfur to phosphorus bonds. In an embodiment, the sulfur-containing phosphorus acid ester may be an acidic thiophosphate, a thiophosphate ester, a thiophosphorus acid or salt thereof. The thiophosphorus acid esters may be dithiophosphorus acid esters. In some more specific approaches, the acidic thiophosphate or thiophosphate ester may have a structure of Formula II or a salt thereof (Formula II)

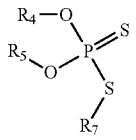

wherein $R_4$ and $R_5$ are each, independently, a linear or branched C1 to C10 hydrocarbyl group and $R_7$ is a C1 to C10 linear or branched carboxylic group or a C1 to C10 linear or branched alkyl alkanoate group. Preferably, $R_4$ and $R_5$ are each a C3 to C8 linear or branched alkyl group and $R_7$ is derived from 2-methyl propanoic acid such that the second phosphorus product (or a salt thereof) has the structure of Formula II below:

(Formula II)

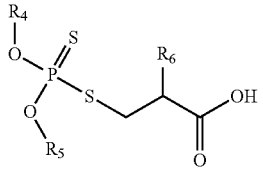

wherein $R_4$ and $R_5$ are, independently, a C3 to C8 linear or branched alkyl group (preferably, a branched C4 group), and $R_6$ is —H or —$CH_3$. In some approaches or embodiments, the second phosphorus product is preferably 3-[[bis(2-methylpropoxy) phosphinothioyl]thio]-2-methyl-propanoic acid.

Third Phosphorus Compound

The third phosphorus compound of the antiwear system herein is dithiophosphate ester amine salt. In approaches, the third phosphorus compound provides about 180 ppm to about 600 ppm of phosphorus to the lubricating composition, in other approaches, about 230 ppm to about 475 ppm of phosphorus, in further approaches, about 135 to about 350 ppm, or in yet other approaches, about 350 ppm to about 470 ppm of phosphorus. In alternative approaches, the lubricating compositions herein include about 0.3 weight percent to about 1.0 weight percent of the third phosphorus compound, in other approaches, about 0.4 weight percent to about 0.8 weight percent, in further approaches, about 0.4 weight percent to about 0.6 weight percent, or in yet other approaches, about 0.6 weight percent to about 0.8 weight percent of the third phosphorus compound.

In other approaches or embodiments, the third phosphorus compound provides phosphorus to the lubricating composition in an amount ranging from at least about 180 ppm, at least about 200 ppm, at least about 220 ppm, at least about 240 ppm, at least about 260 ppm, at least about 280 ppm, at least about 300 ppm, at least about 320 ppm, at least about 340 ppm, or at least about 360 ppm to about 600 ppm or less, about 580 ppm or less, about 580 ppm or less, about 540 ppm or less, about 520 ppm or less, about 500 ppm or less, about 480 ppm or less, about 460 ppm or less, about 440 ppm or less, about 420 ppm or less, about 400 ppm or less, or about 380 ppm or less. In yet other approaches, the treat rate of the third phosphorus compound in the lubricating composition may range from at least about 0.3 weight percent, at least about 0.35 weight percent, at least about 0.4 weight percent, at least about 0.45 weight percent, at least about 0.5 weight percent, at least about 0.55 weight percent, or at least about 0.6 weight percent to about 1.0 weight percent or less, about 0.8 weight percent or less, about 0.7 weight percent or less, about 0.6 weight percent or less, or about 0.55 weight percent or less.

In approaches, the third phosphorus compound is a reaction product made by reacting a phosphorodithioc acid, such as O,O-dihydrocarbyl phosphorodithioic acid, and an epoxide to produce a first reaction product. The first reaction product is then reacted with phosphorus pentoxide to provide a second reaction product. The second reaction product is then neutralized with an amine to provide the third phosphorus compound of the antiwear system.

In approaches or embodiments, a wide variety of phosphorodithioic acids may be used to form the third phosphorus product. In approaches, starting phosphorodithioic acids for producing the third phosphorus product may have the general structure of Formula III (Formula III)

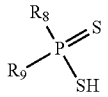

wherein $R_8$ and $R_9$ may be a C1 to C30 hydrocarbyl group and, preferably, butyl, lauryl, 4-methyl-2-pentyl groups and the like linear or branched alkyl groups. The starting acid of Formula III may be prepared by reacting phosphorus pentasulfide with a suitable alcohol or a phenol. In one example, the alcohol or phenol may be reacted with phosphorus pentasulfide at about 50° C. to about 200° C.

In embodiments, suitable epoxides used to form the first reaction product include those of Formula IV (Formula IV)

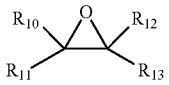

wherein $R_{10}$, $R_{11}$, $R_{12}$, and $R_{13}$ are each, independently, hydrogen or any $C_1$-$C_{30}$ hydrocarbyl group and may preferably include ethylene oxide, propylene oxide, styrene oxide, alpha-methylstyrene oxide, combination thereof, and the like oxides. Preferred oxides include ethylene and/or propylene oxide.

In approaches, suitable amines for neutralizing the second reaction product include aliphatic amines, aromatic amines, cycloaliphatic amines, heterocyclic amines, carbocylic amines, or combinations thereof. In embodiments, the amines may have 4 to 30 carbon atoms. The amines, in some approaches, may include an aliphatic primary amine containing at least about 8 carbon atoms and may have the structure $R_{14}NH_2$, wherein $R_{14}$ is, for example, an aliphatic group such as tert-octyl, tert-dodecyl, tert-tetradecyl, tert-octadecyl, cetyl, behenyl, stearyl, eicosyl, docosyl, tetracosyl, hexatriacontanyl, and pentahexacontanyl. In other embodiments, suitable amines may be a C11 to C20 tertiary alkyl primary amine and, more preferably, a C11 to C14 tertiary alkyl primary amine. Further amines may include, but are not limited to, cyclohexyl amine, n-hexylamine, dodecylamine, di-dodecylamine, tri-dodecylamine, N-methyl-octylamine, butylamine, oleyl amine, myristyl amine, N-dodecyl trimethylene diamine, aniline, o-toluidine, benzidine, phenylene diamine, N,N'-di-sec-butylphenylene diamine, beta-naphthylamine, alpha-naphthylamine, morpholine, piperazine, methane diamine, cyclopentyl amine, ethylene diamine, hexamethylene tetramine, octamethylene diamine, and N,N'-dibutylphenylene diamine.

In other optional approaches, hydroxy-substituted amines may also be used in neutralizing the second reaction product. Exemplary hydroxyl-substituted amines may include ethanolamine, diethanolamine, triethanolamine, isopropanolamine, para-aminophenol, 4-amino-naphthol-1, 8-amino-naphthol-1, beta-aminoalizarin, 2-amino-2-ethyl-1, 3-propandiol, 4-amino-4'-hydroxy-diphenyl ether, 2-amino-resorcinol, N-4-hydroxybutyl-dodecyl amine, N-2-hydroxyethyl-n-octylamine, N-2-hydroxypropyl dinonylamine, N,N-di-(3-hydroxypropyl)-tert-dodecyl amine, N-hydroxytriethoxyethyl-tert-tetradecyl amine, N-2-hydroxyethyl-tert-dodecyl amine, N-hydroxyhexapropoxypropyl-tert-octadecyl amine, and N-5-hydroxypentyl di-n-decyl amine.

Base Oil

In one approach, suitable base oils for use in the lubricating composition or gear fluids herein include mineral oils, synthetic oils, and include all common mineral oil basestocks. The mineral oil may be naphthenic or paraffinic. The mineral oil may be refined by conventional methodology using acid, alkali, and clay or other agents such as aluminium chloride, or may be an extracted oil produced, e.g. by solvent extraction with solvents such as phenol, sulfur dioxide, furfural or dichlorodiethyl ether. The mineral oil may be hydrotreated or hydrofined, dewaxed by chilling or catalytic dewaxing processes, or hydrocracked, such as the Yubase® family of hydrockracked base oils from SK Innovation Co., Ltd. (Seoul, Korea). The mineral oil may be produced from natural crude sources or be composed of isomerized wax materials or residues of other refining processes.

The base oil or base oil of lubricating viscosity used in the compositions herein may be selected from any suitable base oil for driveline or gear oil applications. Examples include the base oils in Groups I-V as specified in the American Petroleum Institute (API) Base Oil Interchangeability Guidelines. These three base oil groups are as follows:

TABLE 1

| Base oil Types | | | | |
|---|---|---|---|---|
| Base oil Category | Sulfur (%) | | Saturates (%) | Viscosity Index |
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

Groups I, II, and III are mineral oil process stocks and may be preferred for the driveline or gear fluids of the present application. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry. Suitable oils may be derived from hydrocracking, hydrogenation, hydrofinishing, unrefined, refined, and re-refined oils, and mixtures thereof. In some approaches, the base oil may be a blend of Group I and Group II oils and the blend may be about 0% to about 100% of the Group I oil, about 0% to about 100% of the Group II oil, about 0% to about 100% of the Group III oil, or various blends of Group I and II, Group I and III, or Group II and III oil blends.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, lubricating oil compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. For example such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

The major amount of base oil included in the gear fluids herein may be selected from the group consisting of Group I, Group II, a Group III, and a combination of two or more of the foregoing, and wherein the major amount of base oil is other than base oils that arise from provision of additive components or viscosity index improvers in the composition. In another embodiment, the major amount of base oil included in a lubricating composition may be selected from the group consisting of Group I, a Group II, and a combination of two or more of the foregoing, and wherein the major amount of base oil is other than base oils that arise from provision of additive components or viscosity index improvers in the composition.

The base oil may also be any of the synthetic base oils. Useful synthetic lubricating oils may include hydrocarbon oils such as polymerized, oligomerized, or interpolymerized olefins (e.g., polybutylenes, polypropylenes, propyleneisobutylene copolymers); poly(1-hexenes), poly(1-octenes), trimers or oligomers of 1-decene, e.g., poly(1-decenes), such materials being often referred to as α-olefins, and mixtures thereof, alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The amount of the base oil of lubricating viscosity in the compositions herein may be the balance remaining after subtracting from 100 wt % the sum of the amount of the performance additives. For example, the oil of lubricating viscosity that may be present in a finished fluid may be a "major amount," such as greater than about 50 wt %, greater than about 60 wt %, greater than about 70 wt %, greater than about 80 wt %, greater than about 85 wt %, greater than about 90 wt %, or greater than 95 wt %.

In some approaches, a preferred base oil or base oil of lubricating viscosity has less than about 25 ppm sulfur, a viscosity index greater than about 120, and a kinematic viscosity at about 100° C. of about 2 to about 8 cSt. In other approaches, the base oil of lubricating viscosity has less than about 25 ppm sulfur, a viscosity index greater than 120, and a kinematic viscosity at 100° C. of about 4 cSt. The base oil may have CP (paraffinic carbon content) of greater than 40%, greater than 45%, greater than 50%, greater than 55%, or greater than 90%. The base oil may have a CA (aromatic carbon content) of less than 5%, less than 3%, or less than 1%. The base oil may have a CN (naphthenic carbon content) of less than 60%, less than 55%, less than 50%, or less than 50% and greater than 30%. The base oil may have a ratio of 1 ring naphthenes to 2-6 ring naphthenes of less than 2 or less than 1.5 or less than 1.

A suitable transmission or gear lubricant composition herein may include additive components in the ranges listed in the following Table 2.

TABLE 2

Suitable and Preferred Transmission or Gear Fluid Compositions

| Component | Wt % (Suitable Embodiments) | Wt % (Preferred Embodiments) |
|---|---|---|
| First Phosphorus Compound | 0.6 to 1.2 | 0.6 to 0.8 or 0.8 to 1.2 |
| Second Phosphorus Compound | 0.1 to 0.5 | 0.1 to 0.3 or 0.3 to 0.4 |
| Third Phosphorus Compound | 0.4 to 1.0 | 0.4 to 0.6 or 0.6 to 0.8 |
| Antioxidant(s) | 0.1-5.0 | 0.01-4.0 |
| Detergent(s) | 0.0-15.0 | 1.0-8.0 |
| Ashless TBN booster(s) | 0.0-1.0 | 0.01-0.5 |
| Corrosion inhibitor(s) | 0.0-5.0 | 0.1-3.0 |
| Metal dihydrocarbyl dithiophosphate(s) | 0.0-15.0 | 0.1-5.0 |
| Ash-free phosphorus compound(s) | 0.0-15.0 | 0.1-5.0 |
| Antifoaming agent(s) | 0.0-1.0 | 0.001-0.5 |
| Antiwear agent(s) | 0.0-1.0 | 0.0-0.8 |
| Pour point depressant(s) | 0.0-1.0 | 0.01-0.5 |
| Viscosity index improver(s) | 0.0-20.0 | 0.1-10.0 |
| Dispersants | 0.0-10.0 | 1.0-6.0 |
| Dispersant viscosity index improver(s) | 0.0-10.0 | 0.0-5.0 |
| Friction modifier(s) | 0.0-10.0 | 0.01-4.0 |
| Extreme Pressure Agent | 0.0-1.05 | .035-.35 |
| Base oil(s) | Balance | Balance |
| Total | 100 | 100 |

The percentages of each component above represent the weight percent of each component, based upon the weight of the total final additive or lubricating oil composition. The balance of the lubricating oil composition consists of one or more base oils or solvents. Additives used in formulating the compositions described herein may be blended into the base oil or solvent individually or in various sub-combinations. However, it may be suitable to blend all of the components concurrently using an additive concentrate (i.e., additives plus a diluent, such as a hydrocarbon solvent).

In approaches or embodiments, the lubricating compositions herein include about 280 ppm to about 840 ppm of phosphorus provided by the first phosphorus compound, about 90 ppm to about 450 ppm of phosphorus provided by the second phosphorus compound, and about 180 ppm to about 600 ppm of phosphorus provided by third phosphorus compound. In alternative approaches, about 30 to about 60 weight percent of the total phosphorus is provided by the first phosphorus compound, about 12 to about 35 weight percent of the total phosphorus is provided by the second phosphorus compound, and about 20 to about 35 weight percent of the total phosphorus is provided by the third phosphorus compound. In yet other optional approaches, the lubricating compositions herein include more of the first phosphorus compound than the second and third phosphorus compounds combined. In any embodiment or approach herein, such combinations of three phosphorus compounds provide a lubricating compositions that achieves a wear scar of about 0.5 mm or less (preferably, about 0.48 mm or less, more preferably, about 0.45 mm or less, and even more preferably about 0.43 mm or less) pursuant to ASTM D4172 (40 kgf) and, at the same time, also has a fail load stage rating of 10 or higher pursuant to CEC L-84 at 90° C. The lubricating compositions herein achieve such performance even with a low viscosity having a KV100 of about 4 to about 15 cSt (preferably about 4 to about 10, about 4 to about 8, and more preferably about 5 to about 8 cSt) as measured at 100° C. using ASTM D445.

The lubricating composition described herein may be formulated to provide lubrication and both good adhesive wear and abrasive wear as discussed above. The lubricating compositions herein may be used for lubricating a machine part, such as a gear, transmission, or gear box component. Lubricating fluids according to the present disclosure can be used in gear applications, such as industrial gear applications, automotive gear applications, axles, and stationary gearboxes. Gear-types can include, but are not limited to, spur, spiral, worm, rack and pinion, involute, bevel, helical, planetary, and hypoid gears and as well as limited-slip applications and differentials. The lubricating compositions disclosed herein are also suitable for automatic or manual transmissions, including step automatic transmissions, continuously variable transmissions, semi-automatic transmissions, automated manual transmissions, toroidal transmissions, and dual clutch transmissions.

Optional Additives

In other approaches, the lubricant including such additives noted above may also include one or more optional components so long as such components and amounts thereof do not impact the performance characteristics as described in the above paragraphs. These optional components are described in the following paragraphs.

Other Phosphorus-Containing Compounds

The lubricant compositions herein may comprise one or more other phosphorus-containing compounds that may impart anti-wear benefits to the fluid so long as the noted phosphorus compounds and amounts above are satisfied. The one or more other phosphorus-containing compounds may be present in the lubricating oil composition in an amount ranging from about 0 wt % to about 15 wt %, or about 0.01 wt % to about 10 wt %, or about 0.05 wt % to about 5 wt %, or about 0.1 wt % to about 3 wt % of the lubricating oil composition. The optional other phosphorus-containing compound may provide up to 5000 ppm phosphorus, or from about 50 ppm to about 5000 ppm phosphorus, or from about 300 ppm to about 1500 ppm phosphorus, or up to 600 ppm phosphorus, or up to 900 ppm phosphorus to the lubricant composition.

The one or more other phosphorus-containing compounds may include ashless phosphorus-containing compounds. Examples of suitable phosphorus-containing compound include, but are not limited to, thiophosphates, dithiophosphates, phosphates, phosphoric acid esters, phosphate esters, phosphites, phosphonates, phosphorus-containing carboxylic esters, ethers, or amides salts thereof, and mixtures thereof. Phosphorus containing anti-wear agents are more fully described in European Patent 0612839.

It should be noted that often the term phosphonate and phosphite are used often interchangeably in the lubricant industry. For example, dibutyl hydrogen phosphonate is often referred to as dibutyl hydrogen phosphite. It is within the scope of the present invention for the inventive lubricant composition to include a phosphorus-containing compound that may be referred to as either a phosphite or a phosphonate.

In any of the above described phosphorus-containing compounds, the compound may have about 5 weight percent to about 20 weight percent phosphorus, or about 5 weight percent to about 15 weight percent phosphorus, or about 8 weight percent to about 16 weight percent phosphorus, or about 6 weight percent to about 9 weight percent phosphorus.

Another type of phosphorus-containing compound that is an ashless (metal free) phosphorus-containing compound. In some embodiments, the ashless phosphorus-containing compound may be dialkyl dithiophosphate ester, amyl acid phosphate, diamyl acid phosphate, dibutyl hydrogen phosphonate, dimethyl octadecyl phosphonate, salts thereof, and mixtures thereof. The ashless phosphorus-containing compound may be have the formula:

(Formula XIV)

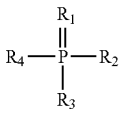

wherein R1 is S or O; R2 is —OR", —OH, or —R"; R3 is —OR", —OH, or SR'"C(O)OH; R4 is —OR"; R'" is C1 to C3 branched or linear alkyl chain; and R" is a C1 to C18 hydrocarbyl chain. When the phosphorous-containing compound has the structure shown in Formula XIV, the compound may have about 8 to about 16 weight percent phosphorus.

In some embodiments the lubricant composition comprises a phosphorus-containing compound of Formula XIV wherein R1 is S; R2 is —OR"; R3 is S R'"COOH; R4 is —OR"; R'" is C3 branched alkyl chain; R" is C4; and wherein the phosphorus-containing compound is present in an amount to deliver between 80-900 ppm phosphorus to the lubricant composition.

In another embodiment, the lubricant composition comprises a phosphorus-containing compound of Formula XIV wherein R1 is O; R2 is —OH; R3 is —OR" or —OH; R4 is —OR"; R" is C5; and wherein phosphorus-containing compound is present in an amount to deliver between 80-1500 ppm phosphorus to the lubricant composition.

In yet another embodiment, the lubricant composition comprises a phosphorus-containing compound of Formula XIV wherein R1 is O; R2 is OR"; R3 is H; R4 is —OR"; R" is C4; and wherein the one or more phosphorus-containing compound(s) is present in an amount to deliver between 80-1550 ppm phosphorus to the lubricant composition.

In other embodiments, the lubricant composition comprises a phosphorus-containing compound of Formula XIV wherein R1 is O; R2 is —R"; R3 is —OCH3 or —OH; R4 is —OCH3; R" is C18; and wherein the one or more phosphorus-containing compound(s) is present in an amount to deliver between 80-850 ppm phosphorus to the lubricant composition.

In some embodiments, the phosphorus-containing compound has the structure shown in Formula XIV and delivers about 80 ppm to about 4500 ppm phosphorus to the lubricant composition. In other embodiments, the phosphorus-containing compound is present in an amount to deliver between about 150 ppm and about 1500 ppm phosphorus, or between about 300 ppm and about 900 ppm phosphorus, or between about 800 ppm to 1600 ppm phosphorus, or about 900 ppm to about 1800 ppm phosphorus, to the lubricant composition.

Other Anti-Wear Agents

The lubricant composition may also include other antiwear agents that are non-phosphorus-containing compounds. Examples of such antiwear agents include borate esters, borate epoxides, thiocarbamate compounds (including thiocarbamate esters, alkylene-coupled thiocarbamates, and bis(S-alkyldithiocarbamyl)disulfides, thiocarbamate amides, thiocarbamic ethers, alkylene-coupled thiocarbamates, and bis(S-alkyldithiocarbamyl) disulfides, and mixtures thereof), sulfurized olefins, tridecyl adipate, titanium compounds, and long chain derivatives of hydroxyl carboxylic acids, such as tartrate derivatives, tartramides, tartrimides, citrates, and mixtures thereof. A suitable thiocarbamate compound is molybdenum dithiocarbamate. Suitable tartrate derivatives or tartrimides may contain alkyl-ester groups, where the sum of carbon atoms on the alkyl groups may be at least 8. The tartrate derivative or tartrimide may contain alkyl-ester groups, where the sum of carbon atoms on the alkyl groups may be at least 8. The antiwear agent may in one embodiment include a citrate. The additional anti-wear agent may be present in ranges including about 0 wt % to about 15 wt %, or about 0.01 wt % to about 10 wt %, or about 0.05 wt % to about 5 wt %, or about 0.1 wt % to about 3 wt % of the lubricating oil composition.

Other Extreme Pressure Agents

The lubricant compositions of the disclosure may also contain other extreme pressure agent(s). The extreme pressure agent may contain sulfur and may contain at least 12 percent by weight sulfur. In some embodiments, the extreme pressure agent added to the lubricating oil is sufficient to provide at least 350 ppm sulfur, 500 ppm sulfur, 760 ppm sulfur, from about 350 ppm to about 2,000 ppm sulfur, from about 2,000 ppm to about 30,000 ppm sulfur, or from about 2,000 ppm to about 4,800 ppm sulfur, or about 4,000 ppm to about 25,000 ppm sulfur to the lubricant composition.

A wide variety of sulfur-containing extreme pressure agents are suitable and include sulfurized animal or vegetable fats or oils, sulfurized animal or vegetable fatty acid esters, fully or partially esterified esters of trivalent or pentavalent acids of phosphorus, sulfurized olefins (see, for example U.S. Pat. Nos. 2,995,569; 3,673,090; 3,703,504; 3,703,505; 3,796,661; 3,873,454 4,119,549; 4,119,550; 4,147,640; 4,191,659; 4,240,958; 4,344,854; 4,472,306; and 4,711,736), dihydrocarbyl polysulfides (see for example U.S. Pat. Nos. 2,237,625; 2,237,627; 2,527,948; 2,695,316; 3,022,351; 3,308,166; 3,392,201; 4,564,709; and British 1,162,334), functionally-substituted dihydrocarbyl polysulfides (see for example U.S. Pat. No. 4,218,332), and polysulfide olefin products (see for example U.S. Pat. No. 4,795,576). Other suitable examples include organo-sulfur compounds selected from sulfurized olefins, sulfur-containing amino heterocyclic compounds, 5-dimercapto-1,3,4-thiadiazole, polysulfides having a majority of S3 and S4 sulfides, sulfurized fatty acids, sulfurized branched olefins, organic polysulfides, and mixtures thereof.

In some embodiments the extreme pressure agent is present in the lubricating composition in an amount of up to about 3.0 wt % or up to about 5.0 wt %. In other embodiments, the extreme pressure agent is present from about 0.05 wt % to about 0.5 wt %, based on the total lubricant composition. In other embodiments, the extreme pressure agent is present from about 0.1 wt % to about 3.0 wt %, based on the total lubricant composition. In other embodiments the extreme pressure agent is present in an amount between about 0.6 wt % and about 1 wt %, based on the total lubricant composition. In yet other embodiments, the detergent is present in an amount of about 1.0 wt %, based on the total lubricant composition.

One suitable class of extreme pressure agents are polysulfides composed of one or more compounds represented by the formula: Ra-Sx-Rb where Ra and Rb are hydrocarbyl groups each of which may contain 1 to 18, and in other approaches, 3 to 18 carbon atoms and x is may be in the range of from 2 to 8, and typically in the range of from 2 to 5, especially 3. In some approaches, x is an integer from 3 to 5 with about 30 to about 60 percent of x being an integer of 3 or 4. The hydrocarbyl groups can be of widely varying types such as alkyl, cycloalkyl, alkenyl, aryl, or aralkyl. Tertiary alkyl polysulfides such as di-tert-butyl trisulfide, and mixtures comprising di-tert-butyl trisulfide (e.g., a mixture composed principally or entirely of the tri, tetra-, and pentasulfides) may be used. Examples of other useful dihydrocarbyl polysulfides include the diamyl polysulfides, the dinonyl polysulfides, the didodecyl polysulfides, and the dibenzyl polysulfides.

Another suitable class of extreme pressure agent is sulfurized isobutenes made by reacting an olefin, such as isobutene, with sulfur. Sulfurized isobutene (SIB), notably sulfurized polyisobutylene, typically has a sulfur content of from about 10 to about 55%, desirably from about 30 to about 50% by weight. A wide variety of other olefins or unsaturated hydrocarbons, e.g., isobutene dimer or trimer, may be used to form the sulfurized olefin extreme pressure agents. Various methods have been disclosed in the prior art for the preparation of sulfurized olefins. See, for example, U.S. Pat. No. 3,471,404 to Myers; U.S. Pat. No. 4,204,969 to Papay et al.; U.S. Pat. No. 4,954,274 to Zaweski et al.; U.S. Pat. No. 4,966,720 to DeGonia et al.; and U.S. Pat. No. 3,703,504 to Horodysky, et al, each of which his incorporated herein by reference.

Methods for preparing sulfurized olefins, including the methods disclosed in the aforementioned patents, generally involve formation of a material, typically referred to as an "adduct", in which an olefin is reacted with a sulfur halide, for example, sulfur monochloride. The adduct is then reacted with a sulfur source to provide the sulfurized olefin. The quality of a sulfurized olefin is generally measured by various physical properties, including, for example, viscosity, sulfur content, halogen content and copper corrosion test weight loss. U.S. Pat. No. 4,966,720, relates to sulfurized olefins useful as extreme pressure additives in lubrication oils and to a two stage reaction for their preparation.

Antioxidants

The lubricating oil compositions herein also may optionally contain one or more antioxidants. Antioxidant compounds are known and include for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidant compounds may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox® L-135 available from BASF or an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms. Another commercially available hindered phenol antioxidant may be an ester and may include Ethanox® 4716 available from Albemarle Corporation.

Useful antioxidants may include diarylamines and phenols. In an embodiment, the lubricating oil composition may contain a mixture of a diarylamine and a phenol, such that each antioxidant may be present in an amount sufficient to provide up to about 5 wt %, based on the weight of the lubricant composition. In an embodiment, the antioxidant may be a mixture of about 0.3 to about 1.5 wt % diarylamine and about 0.4 to about 2.5 wt % phenol, based on the lubricant composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In one embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. Fatty acids and/or ester may be mixed with olefins, such as α-olefins.

The one or more antioxidant(s) may be present in ranges about 0 wt % to about 20 wt %, or about 0.1 wt % to about 10 wt %, or about 1 wt % to about 5 wt %, of the lubricating oil composition.

Dispersants

Dispersants contained in the lubricant composition may include, but are not limited to, an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. Dispersants may be selected from Mannich dispersants as described in U.S. Pat. Nos. 3,634,515, 3,697,574 and 3,736,357; ashless succinimide dispersants as described in U.S. Pat. Nos. 4,234,435 and 4,636,322; amine dispersants as described in U.S. Pat. Nos. 3,219,666, 3,565,804, and 5,633,326; Koch dispersants as described in U.S. Pat. Nos. 5,936,041, 5,643,859, and 5,627,259, and polyalkylene succinimide dispersants as described in U.S. Pat. Nos. 5,851,965; 5,853,434; and 5,792,729.

In some embodiments, the additional dispersant may be derived from a polyalphaolefin (PAO) succinic anhydride, an olefin maleic anhydride copolymer. As an example, the additional dispersant may be described as a poly-PIBSA. In another embodiment, the additional dispersant may be derived from an anhydride which is grafted to an ethylene-propylene copolymer. Another additional dispersant may be a high molecular weight ester or half ester amide.

The additional dispersant, if present, can be used in an amount sufficient to provide up to about 10 wt %, based upon the final weight of the lubricating oil composition. Another amount of the dispersant that can be used may be about 0.1 wt % to about 10 wt %, or about 0.1 wt % to about 10 wt %, or about 3 wt % to about 8 wt %, or about 1 wt % to about 6 wt %, based upon the final weight of the lubricating oil composition.

Viscosity Index Improvers

The lubricant compositions herein also may optionally contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 20120101017A1, which is incorporated herein by reference.

The lubricating oil compositions herein also may optionally contain one or more dispersant viscosity index improvers in addition to a viscosity index improver or in lieu of a viscosity index improver. Suitable viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver may be about 0 wt % to about 20 wt %, about 0.1 wt % to about 15 wt %, about 0.1 wt % to about 12 wt %, or about 0.5 wt % to about 10 wt %, about 3 wt % to about 20 wt %, about 3 wt % to about 15 wt %, about 5 wt % to about 15 wt %, or about 5 wt % to about 10 wt %, of the lubricating oil composition.

In some embodiments, the viscosity index improver is a polyolefin or olefin copolymer having a number average molecular weight of about 10,000 to about 500,000, about 50,000 to about 200,000, or about 50,000 to about 150,000. In some embodiments, the viscosity index improver is a hydrogenated styrene/butadiene copolymer having a number average molecular weight of about 40,000 to about 500,000, about 50,000 to about 200,000, or about 50,000 to about 150,000. In some embodiments, the viscosity index improver is a polymethacrylate having a number average molecular weight of about 10,000 to about 500,000, about 50,000 to about 200,000, or about 50,000 to about 150,000.

Other Optional Additives

Other additives may be selected to perform one or more functions required of lubricant composition. Further, one or more of the mentioned additives may be multi-functional and provide functions in addition to or other than the function prescribed herein. The other additives may be in addition to specified additives of the present disclosure and/or may comprise one or more of metal deactivators, viscosity index improvers, ashless TBN boosters, antiwear agents, corrosion inhibitors, rust inhibitors, dispersants, dispersant viscosity index improvers, extreme pressure agents, antioxidants, foam inhibitors, demulsifiers, emulsifiers, pour point depressants, seal swelling agents and mixtures thereof. Typically, fully-formulated lubricating oil will contain one or more of these additives.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Suitable foam inhibitors include silicon-based compounds, such as siloxane.

Suitable pour point depressants may include a polymethylmethacrylates or mixtures thereof. Pour point depressants may be present in an amount sufficient to provide from about 0 wt % to about 1 wt %, about 0.01 wt % to about 0.5 wt %, or about 0.02 wt % to about 0.04 wt % based upon the final weight of the lubricating oil composition.

Suitable rust inhibitors may be a single compound or a mixture of compounds having the property of inhibiting corrosion of ferrous metal surfaces. Non-limiting examples of rust inhibitors useful herein include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable corrosion inhibitors include long-chain alpha, omega-dicarboxylic acids in the molecular weight range of about 600 to about 3000 and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid. In some embodiments, an engine oil is devoid of a rust inhibitor.

The rust inhibitor, if present, can be used in optional amount sufficient to provide about 0 wt % to about 5 wt %, about 0.01 wt % to about 3 wt %, about 0.1 wt % to about 2 wt %, based upon the final weight of the lubricating oil composition.

The lubricant composition may also include corrosion inhibitors (it should be noted that some of the other mentioned components may also have copper corrosion inhibition properties). Suitable inhibitors of copper corrosion include ether amines, polyethoxylated compounds such as ethoxylated amines and ethoxylated alcohols, imidazolines, monoalkyl and dialkyl thiadiazole, and the like.

Thiazoles, triazoles and thiadiazoles may also be used in the lubricants. Examples include benzotriazole, tolyltriazole, octyltriazole, decyltriazole; dodecyltriazole, 2-mercaptobenzothiazole, 2,5-dimercapto-1,3,4-thiadiazole, 2-mercapto-5-hydrocarbylthio-1,3,4-thiadiazoles, and 2-mercapto-5-hydrocarbyldithio-1,3,4-thiadiazoles. In one embodiment, the lubricant composition includes a 1,3,4-thiadiazole, such as 2-hydrocarbyldithio-5-mercapto-1,3,4-dithiadiazole.

Anti-foam/Surfactant agents may also be included in a fluid according to the present invention. Various agents are known for such use. Copolymers of ethyl acrylate and hexyl ethyl acrylate, such as PC-1244, available from Solutia may be used. In other embodiments, silicone fluids, such as 4% DCF may be included. Mixtures of anti-foam agents may also be present in the lubricant composition.

EXAMPLES

The following examples are illustrative of exemplary embodiments of the disclosure. In these examples, as well as elsewhere in this application, all ratios, parts, and percentages are by weight unless otherwise indicated. It is intended that these examples are being presented for the purpose of illustration only and are not intended to limit the scope of the invention disclosed herein.

Example 1

The following three phosphorus compounds were evaluated for both adhesive and abrasive wear in lubricating compositions:

Phosphorus Compound A: Tris(2-ethylhexyl) phosphate (contains 7 wt % Phosphorus) and having the following structure:

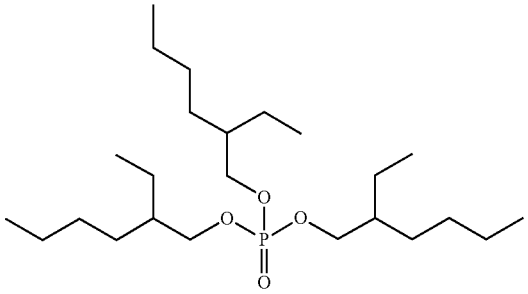

Phosphorus Compound B: 3-[[bis(2-methylpropoxy) phosphinothioy]thio]-2-methyl-propanoic acid (contains 9 wt % phosphorus) and having the following structure:

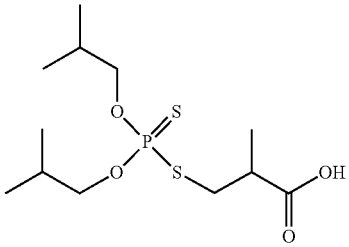

Phosphorus Compound C: a phosphorus product containing about 5.9 wt % phosphorus and formed by (i) reacting an O,O-di(4-methyl-2-pentyl) phosphorodithioic acid with propylene oxide, to form a first reaction product; (ii) reacting the first reaction product with phosphorus pentoxide to produce an acid phosphate intermediate; and (iii) neutralizing at least a major portion of the intermediate with a C11-C14 tertiary alkyl primary amine. Compound C include about 30 weight percent of mineral oil.

Phosphorus compounds A, B, and/or C were incorporated into a low viscosity fluid in the amounts set forth in Table 3. Each lubricant also included the same additive package of detergents, dispersants, corrosion inhibitor, antioxidants and anti-foam agents. Each lubricant also includes a mineral base oil to achieve a KV100 of about 6 cSt as shown in Table 4.

TABLE 3

| Lubricant Formulations (wt %) | | | | | | | | |
|---|---|---|---|---|---|---|---|---|
| | Inv Ex 1 | Comp. Ex 1 | Comp. Ex 2 | Comp. Ex 3 | Comp. Ex 4 | Comp. Ex 5 | Comp. Ex 6 | Comp. Ex 7 |
| Phosphorus Compound A | 0.48 | | 1.43 | | | 0.72 | 0.72 | |
| Phosphorus Compound B | 0.37 | | | 1.11 | | 0.56 | | 0.56 |
| Phosphorus Compound C | 0.57 | | | | 1.7 | | 0.85 | 0.85 |

The ability of each fluid to provide abrasive wear and adhesive wear protection for a gear surface was measured using ASTM D4172 (1200 rpm/40 kg/75° C./1 Hr) and CEC L-84 (at 90° C.), respectively. Results are shown below in Table 4.

TABLE 4

| | Inv Ex 1 | Comp. Ex 1 | Comp. Ex 2 | Comp. Ex 3 | Comp. Ex 4 | Comp. Ex 5 | Comp Ex 6 | Comp Ex 7 |
|---|---|---|---|---|---|---|---|---|
| KV100° C. (cSt) | 6.2 | 6.2 | 6.1 | 6.2 | 6.2 | 6.1 | 6.2 | 6.2 |
| Phosphorus (ppm) | 1013 | 0 | 989 | 963 | 1103 | 981 | 1034 | 1016 |
| ASTM D4172 (mm) | 0.43 | 0.54 | 0.61 | 0.43 | 1.29 | 0.48 | 0.64 | 0.46 |
| CEC L-84 at 90° C. (FLS) | 10 | 6 | 7 | 8 | 11 | 9 | 10 | 8 |

When the fluid does not contain any phosphorus compounds (Comp Ex 1), the fluid has poor ASTM D4172 (40 kgf) performance resulting in a wear scar of 0.54 mm. Comp. Ex 1 also has poor adhesive wear performance, resulting in a fail load stage (FLS) of 6. The target performance for a fluid is ASTM D4172 (40 kgf) to be lower than 0.5 mm and the CEC L-84 to have higher than FLS (fail load stage) 9 and, preferably, FLS 10 or higher. When either phosphorus product A, B, or C is used alone or in combination with only one other phosphorus compound at equivalent level of phosphorus in the fluid (Comp. Ex 2-7), either the ASTM D4172 or CEC L-84 does not meet the required level of performance. It is only when all three phosphorus compounds A, B, and C are used together does the fluid meet the required level of performance (Inv Ex. 1) with ASTM D4172 (40 kgf) giving, for example, a wear scar of 0.43 mm and CEC L-84 demonstrating FLS 10.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A transmission or gearbox lubricating composition comprising:

(i) a base oil of lubricating viscosity;

(ii) a first phosphorus compound comprising a trialkyl phosphate ester of Formula I:

(Formula I)

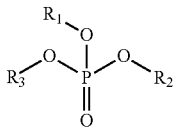

wherein $R_1$, $R_2$, and $R_3$ are, independently, a C4 to C8 linear or branched alkyl group;

(iii) a second phosphorus compound comprising an ashless, dialkyl dithiophosphate of Formula II, or a salt thereof:

(Formula II)

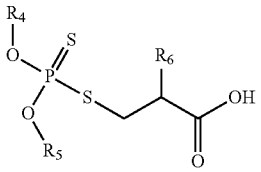

wherein $R_4$ and $R_5$ are, independently, a C3 to C8 linear or branched alkyl group, and $R_6$ is —H or —$CH_3$;

(iv) a third phosphorus compound prepared by reacting an O,O-di (4-methyl-2-pentyl) phosphorodithioic acid with ethylene and/or propylene oxide to provide a first reaction product and further reacting said first reaction product with phosphorus pentoxide to provide a second reaction product and neutralizing said second reaction product with one or more tertiary aliphatic primary amines to provide said third phosphorus compound; and wherein said first, second, and third phosphorus compounds provide a total of about 800 to about 2000 ppm phosphorus to the lubricating composition, wherein the first phosphorus compound provides about 280 ppm to about 840 ppm of phosphorus to the lubricating composition, wherein the second phosphorus compound provides about 90 to about 450 ppm of phosphorus to the lubricating composition, and wherein the third phosphorus compound provides about 80 to about 600 ppm of phosphorus to the lubricating composition.

2. The lubricating composition of claim 1, wherein the first phosphorus compound is tris (2-ethylhexyl) phosphate.

3. The lubricating composition of claim 1, wherein the second phosphorus compound is 3-[[bis(2-methylpropoxy) phosphinothioyl]thio]-2-methyl-propanoic acid.

4. The lubricating composition of claim 1, wherein the first phosphorus compound provides about 280 ppm to about 840 ppm of phosphorus to the lubricating composition; the second phosphorus compound provides about 90 to about 450 ppm of phosphorus to the lubricating composition, and the third phosphorus compound provides about 180 to about 600 ppm of phosphorus to the lubricating composition.

5. The lubricating composition of claim 1, wherein the lubricating composition exhibits a wear scar of about 0.5 mm or less pursuant to ASTM D4172 (40 kgf) and has a fail load stage rating of 10 or higher pursuant to CEC L-84 at 90° C.

6. The lubricating composition of claim 1, wherein about 30 to about 60 weight percent of the total phosphorus is provided by the first phosphorus compound, about 12 to about 35 weight percent of the total phosphorus is provided by the second phosphorus compound, and about 20 to about 35 weight percent of the total phosphorus is provided by the third phosphorus compound.

7. The lubricating composition of claim 1, wherein the lubricating composition has a KV100 of about 4 to about 10 cSt.

8. The lubricating composition of claim 1, wherein the lubricating composition includes more of the first phosphorus compound than the second and third phosphorus compounds combined.

9. A method of lubricating a transmission or gearbox, the method comprising:

lubricating a transmission or gearbox component with a lubricating composition; and wherein the lubricating composition includes (i) a base oil of lubricating viscosity; and (ii) a first phosphorus compound comprising a trialkyl phosphate ester of Formula I:

(Formula I)

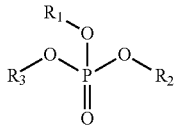

wherein $R_1$, $R_2$, and $R_3$ are, independently, a C4 to C8 linear or branched alkyl group, (iii) a second phosphorus compound comprising an ashless, dialkyl dithiophosphate of Formula II, or a salt thereof:

(Formula II)

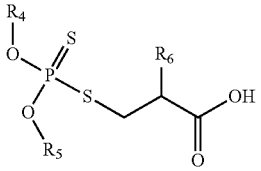

wherein $R_4$ and $R_5$ are, independently, a C3 to C8 linear or branched alkyl group, and $R_6$ is —H or —$CH_3$, and (iv) a third phosphorus compound prepared by reacting an O,O-di (4-methyl-2-pentyl) phosphorodithioic acid with ethylene and/or propylene oxide to provide a first reaction product and further reacting said first reaction product with phosphorus pentoxide to provide a second reaction product and neutralizing said second reaction product with one or more tertiary aliphatic primary amines to provide said third phosphorus compound; and wherein said first, second, and third phosphorus compounds provide a total of about 800 to about 2000 ppm phosphorus to the lubricating composition, and wherein about 30 to about 60 weight percent of the total phosphorus is provided by the first phosphorus compound, about 12 to about 35 weight percent of the total phosphorus is provided by the second phosphorus compound, and about 20 to about 35 weight percent of the total phosphorus is provided by the third phosphorus compound.

10. The method of claim 9, wherein the first phosphorus compound is tris (2-ethylhexyl) phosphate.

11. The method of claim 9, wherein the first phosphorus compound provides about 280 ppm to about 840 ppm of phosphorus to the lubricating composition.

12. The method of claim 9, wherein the second phosphorus compound is 3-[[bis(2-methylpropoxy) phosphinothioyl]thio]-2-methyl-propanoic acid.

13. The method of claim 9, wherein the second phosphorus compound provides about 90 to about 450 ppm of phosphorus to the lubricating composition.

14. The method of claim 9, wherein the third phosphorus compound provides about 180 to about 600 ppm of phosphorus to the lubricating composition.

15. The method of claim 9, wherein the lubricating composition exhibits a wear scar of about 0.5 mm or less pursuant to ASTM D4172 (40 kgf) and has a fail load stage rating of 10 or higher pursuant to CEC L-84 at 90° C.

16. The method of claim 9, wherein the lubricating composition has a KV100 of about 4 to about 10 cSt.

17. The method of claim 9, wherein the lubricating composition includes more of the first phosphorus compound than the second and third phosphorus compounds combined.

18. The method of claim 9, wherein the first phosphorus compound provides about 280 ppm to about 840 ppm of phosphorus to the lubricating composition; the second phosphorus compound provides about 90 to about 450 ppm of phosphorus to the lubricating composition, and the third phosphorus compound provides about 180 to about 600 ppm of phosphorus to the lubricating composition.

* * * * *